United States Patent [19]

Wittchow et al.

[11] Patent Number: 4,841,727

[45] Date of Patent: Jun. 27, 1989

[54] DEVICE FOR GENERATING FLUE GAS TO DRIVE A GAS TURBINE

[75] Inventors: Eberhard Wittchow; Rudolf Pieper, both of Erlangen, Fed. Rep. of Germany

[73] Assignee: Siemens Aktiengesellschaft, Munich, Fed. Rep. of Germany

[21] Appl. No.: 154,071

[22] Filed: Feb. 9, 1988

[30] Foreign Application Priority Data

Feb. 9, 1987 [DE] Fed. Rep. of Germany ..... 3703945
Dec. 4, 1987 [DE] Fed. Rep. of Germany ..... 3741196

[51] Int. Cl.[4] ..... F02C 3/26

[52] U.S. Cl. ..... 60/39.464; 110/264; 122/4 D

[58] Field of Search ..... 60/39, 182, 39.464; 110/263, 264, 265, 266; 122/4 D; 431/170

[56] References Cited

U.S. PATENT DOCUMENTS

| | | | |
|---|---|---|---|
| 2,616,256 | 11/1952 | Davy et al. | 60/39.464 |
| 2,672,012 | 3/1954 | Veron | 60/39.464 |
| 3,286,666 | 11/1966 | Ohlsson | 110/264 |
| 3,863,606 | 2/1975 | Bryers et al. | 122/4 D |
| 4,269,151 | 5/1981 | Bojesgard et al. | 122/4 D |
| 4,715,301 | 12/1987 | Bianca et al. | 110/264 |
| 4,790,267 | 12/1988 | Mollenhoff et al. | 122/4 D |

FOREIGN PATENT DOCUMENTS 3132659 3/1983 Fed. Rep. of Germany .

*Primary Examiner*—Louis J. Casaregola

*Attorney, Agent, or Firm*—Herbert L. Lerner; Laurence A. Greenberg

[57] ABSTRACT

A device for generating flue gas for driving a gas turbine includes a stack in a closed hollow cylindrical housing having a stack wall spaced from the housing. One of the ends of the stack has a combustion chamber, a closure element, as well as an inlet opening for combustion air discharging into the combustion chamber and a supply opening for fine grained coal together forming a pulverized coal burner. The inlet opening generates a spin of the combustion air in a given rotational direction. A first auxiliary inlet for combustion air discharges in the combustion chamber. A second auxiliary inlet for fine grained coal is disposed in the stack wall and discharges into the combustion chamber at a distance from the closure element. A flue gas outlet connector is disposed in and spaced from an air inlet connector of the housing at the other end of the stack. An air nozzle is disposed in the stack wall at a distance from the first auxiliary inlet and discharges tangentially into the stack creating a spin in supplied air having the given rotational direction and ending in the stack in a direction toward the lower end of the stack. A helically shaped guide plate for flue gas is disposed on the stack wall inside the stack between the first auxiliary inlet and the air nozzle. The guide plate imparts a spin to the flue gas having the given rotational direction. The stack wall has a step formed therein defining a change in cross section of the stack and having an outlet opening for ash disposed therein.

22 Claims, 4 Drawing Sheets

DEVICE FOR GENERATING FLUE GAS TO DRIVE A GAS TURBINE

The invention relates to a device for the generation of flue gas for driving a gas turbine, in particular a steam generator or steam superheater, including a closed hollow cylindrical housing having an air inlet connector, a stack longitudinally extended in the housing, the stack having two ends and having a stack wall spaced from the housing defining an intermediate space therebetween, a combustion chamber disposed at one of the ends of the stack, a closure element disposed at the one end of the stack, an inlet opening for combustion air being disposed at the one end of the stack and discharging into the combustion chamber, a supply opening for fine grained coal disposed at the one end of the stack, and a flue gas outlet connector disposed in and spaced from the air inlet connector of the housing at the other end of the stack.

Such a device in the form of a steam generator is known from German Published, Non-Prosecuted Application DE-OS 31 32 659. The inlets for the combustion air of this known device terminate at the bottom in the combustion chamber in an axial direction and a fluidized bed is created from the combustion air and the fine grained coal which is supplied. Combustion of the fine grained coal which is supplied takes place under considerable overpressure relative to the atmosphere in the fluidized bed, in which the convection heating surfaces of the steam generator are located.

Additionally, fine grained limestone is supplied to the fluidized bed in order to fix the sulphur dioxide created during combustion. Due to this chemical reaction, the combustion temperature may not be higher than 850° C. Thus a comparatively small amount of nitrogen oxide is created. However, the result of the low combustion temperature is a low inlet temperature of the flue gas, used for a gas turbine attached to the flue gas outlet connector of the steam generator.

It is accordingly an object of the invention to provide a device for generating flue gas to drive a gas turbine, which overcomes the hereinafore-mentioned disadvantages of the heretofore-known devices of this general type, which permits an increase in the temperature of the flue gas at the flue gas outlet connector in order to thereby improve the efficiency of the power plant into which the device is integrated, and which still suppresses the formation of nitrogen oxides to a large degree.

With the foregoing and other objects in view there is provided, in accordance with the invention, a device for generating flue gas for driving a gas turbine, comprising a closed hollow cylindrical housing having an air inlet connector, a stack longitudinally extended in the housing, the stack having upper and lower ends and having a stack wall spaced from the housing defining an intermediate space therebetween, a combustion chamber disposed at one of the ends of the stack, a closure element disposed at the one end of the stack, inlet opening means for combustion air being disposed at the one end of the stack and discharging into the combustion chamber, supply opening means for fine grained coal disposed at the one end of the stack and forming a pulverized coal burner along with the inlet opening means, the inlet opening means including means for generating a spin of the combustion air in a given rotational direction, first auxiliary inlet means for combustion air discharging in the combustion chamber, second auxiliary inlet means for fine grained coal disposed in the stack wall and discharging into the combustion chamber a distance from the closure element, a flue gas outlet connector disposed in and spaced from the air inlet connector of the housing at the other end of the stack, an air nozzle disposed in the stack wall a distance from the first auxiliary inlet means as seen in flue gas flow direction, the air nozzle discharging tangentially into the stack providing means for creating a spin in supplied air having the given rotational direction and ending in the stack in a direction toward the lower end of the stack, a helically shaped guide plate for flue gas disposed on the stack wall inside the stack between the first auxiliary inlet means and the air nozzle, the guide plate being wound in a direction providing means for imparted a spin to the flue gas having the given rotational direction, the stack wall having a step formed therein defining a change in cross section of the stack, and the step having an outlet opening for ash disposed therein.

In accordance with another feature of the invention, the means for generating a spin of the combustion air are in the from of a tangential inlet leading into the combustion chamber or guide vanes.

In accordance with a further feature of the invention, the a step is disposed between the guide plate and the air nozzle or between the air nozzle and the flue gas outlet connector.

Combustion of the fine grained coal by means of the pulverized coal burner in the device according to the invention takes place at a combustion temperature higher than 850° C., because the sulphur dioxide being formed is not fixed during combustion, but instead at a later time. Even though the flue gas being generated during combustion would be cooled by a convection heating surface, the flue gas at the flue gas outlet connector of the device still would have a temperature considerably higher than 850° C. Although the inlet for the combustion air can be axially oriented, a spin of the combustion air generated by the disposition or shape of the inlet for the combustion air even creates a return of hot flue gases into the vicinity of the supply opening for the fine grained coal and thus guarantees flawless ignition of the fine grained coal in spite of the short time during which the coal remains in the combustion chamber. Due to the spatial separation of the air nozzle from the inlet for the combustion air or the separation of the auxiliary inlet for fine grained coal from the supply opening for fine grained coal, the released heat is evenly distributed throughout the combustion chamber during combustion. Furthermore, combustion can take place with a large excess amount of air and thus with reduced combustion temperatures, thus bringing about an extensive suppression of nitrogen oxide formation. Additionally, the flue gas is already freed of dust to a large extent within the device for generating the flue gas.

In accordance with an added feature of the invention, the stack wall is formed of pipes air-tightly welded together. In accordance with an additional feature of the invention, the closure element is formed of pipes air-tightly welded together.

In accordance with yet another feature of the invention, the first auxiliary inlet means are disposed at a distance from the closure element.

In accordance with yet a further feature of the invention, the stack has a convection heating surface at the other end thereof containing the flue gas outlet connector, and the supply opening means and the inlet opening means of the pulverized coal burner are disposed upstream of the convection heating surface as seen in the flue gas flow direction.

In accordance with yet an added feature of the invention, the step is disposed between the air nozzle and the convection heating surface.

In accordance with yet an additional feature of the invention, there is provided a pump supplying a pumpable mixture of water and fine grained coal to the pulverized coal burner.

In accordance with still another feature of the invention, the combustion chamber has a cross section in the form of a circle or a regular polygon.

In accordance with still a further feature of the invention, the first auxiliary inlet means discharge tangentially into the combustion chamber providing means for creating a spin in supplied combustion air in the given rotational direction.

In accordance with still an added feature of the invention, the first auxiliary inlet means discharge radially into the combustion chamber.

In accordance with still an additional feature of the invention, the combustion chamber has a cross section increasing upstream of the first auxiliary inlet means as seen in the flue gas flow direction, starting at the one end of the stack containing the closure element.

In accordance with again another feature of the invention, the guide plate is formed of pipes welded air-tightly together forming a convection heating surface.

In accordance with again a further feature of the invention, there is provided a an air compressor communicating with the intermediate space, with the air nozzle and with the inlet opening means, and the first auxiliary inlet means communicate with the intermediate space.

In accordance with again an added feature of the invention, there is provided a heating surface formed of air-tightly welded together pipes disposed in the center of the stack between the first auxiliary inlet means and the convection heating surface.

In accordance with a concomitant feature of the invention, there is provided a further air compressor upstream of the first-mentioned air compressor, and a drive unit with adjustable rpm being connected to the further air compressor.

Other features which are considered as characteristic for the invention are set forth in the appended claims.

Although the invention is illustrated and described herein as embodied in a device for generating flue gas to drive a gas turbine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
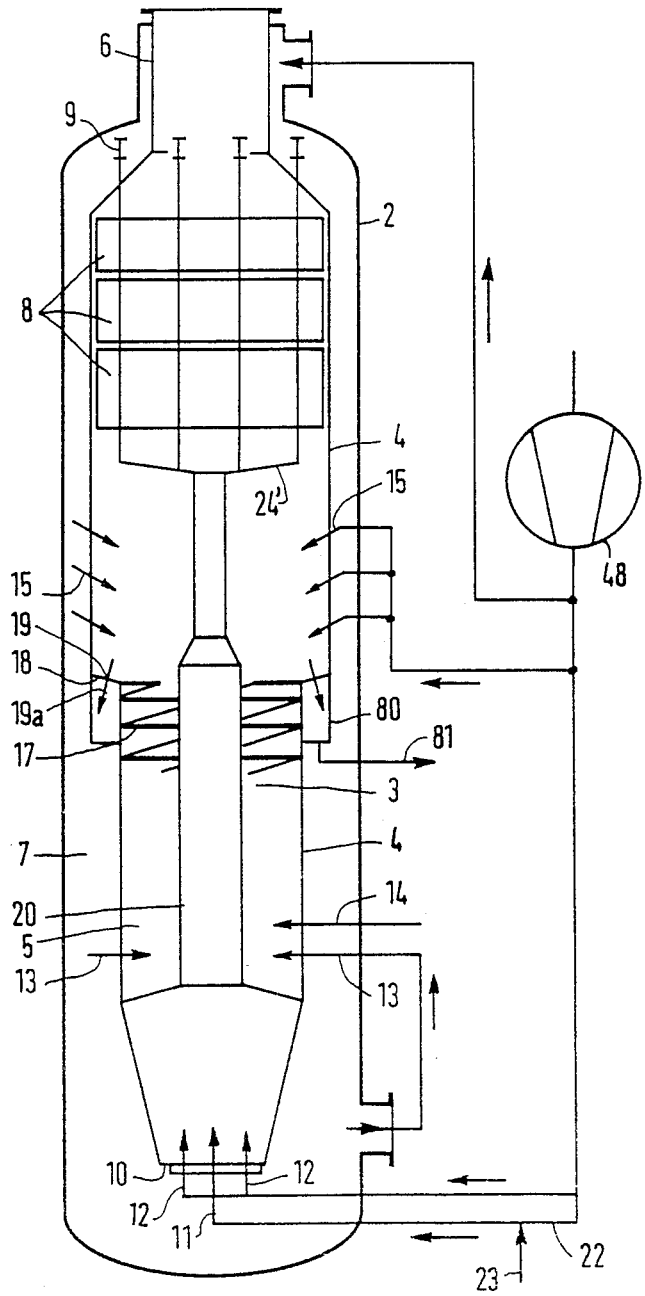
FIG. 1 is a largely diagrammatic, longitudinal-sectional view of a device according to the invention in the form of a steam generator.

Referring now to the figures of the drawings in detail and first, particularly, to FIG. 1 thereof, there is seen a steam generator having a housing 2 in the form of a hollow cylinder in which a longitudinally extending stack 3 is coaxially disposed. A stack wall 4 of the longitudinally extending stack 3 is formed by finned pipes which are welded together in an air-tight manner.

The hollow cylinder-like housing 2 and the stack 3 are vertically disposed. The end of the stack forming the lower end of the stack 3 has a combustion chamber 5, while the end of the stack forming the upper end of the stack 3 has a flue gas outlet connector 6. A space 7 is formed inside the hollow cylinder-like housing 2 between the stack 3 or the flue gas outlet connector 6 and the hollow cylinder-like housing 2.

Convection heating surfaces 8 which are suspended from supports 9 are located upstream of the flue gas outlet connector 6 within the stack 3.

A closure element 10 on the end of the stack forming the lower end of the stack 3 is also formed of finned pipes which are welded together to be air-tight. A supply opening 11 for fine grained coal is disposed on the closure element 10 and terminates in the combustion chamber 5. Additionally, disposed on the closure element 10 is an inlet 12 for combustion air which forms a pulverized coal burner together with the supply opening 11 for the fine grained coal.

The cross section of the combustion chamber 5 is in the form of a circle at the end of the stack forming the lower end of the stack 3. The cross section widens conically towards the flue gas outlet connector 6, as seen in the direction of the flue gas flow, to the point of two auxiliary inlets 13 for combustion air which are disposed in the stack wall 4 of the stack 3.

A further auxiliary inlet 14 for fine grained coal in the stack wall 4 is disposed at a distance from the closure element 10, but within the combustion chamber 5.

Air nozzles 15 are located at a distance from the auxiliary inlets 13 for combustion air and the auxiliary inlet 14 for fine grained coal, as seen in the direction of the flue gas flow towards the flue gas outlet connector 6. The air nozzles 15 are also disposed upstream of the convection heating surfaces 8, as seen in the direction of the flue gas flow.

Figure 2:
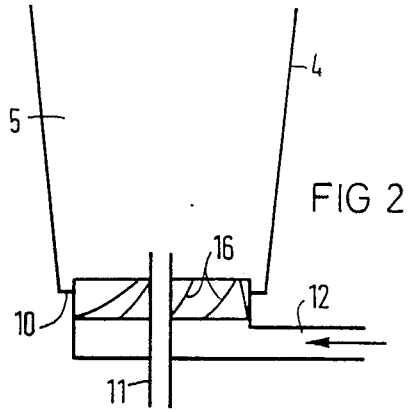
FIGS. 2 and 3 are respective fragmentary, longitudinal-sectional and top-plan views showing details of the device shown in FIG. 1.
Figure 3:
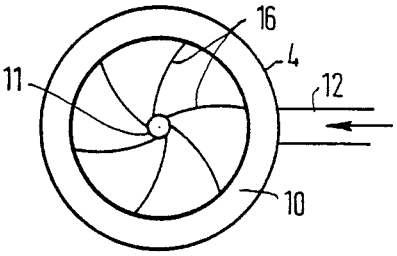

As shown in FIGS. 2 and 3, the supply opening 11 for fine grained coal terminates centrally and in an axial direction in the combustion chamber 5. The inlet 12 for combustion air annularly surrounds the supply opening 11 for fine grained coal. The supply opening 12 contains guide vanes 16 which impart a spin to the combustion air supplied to the combustion chamber 5.

The auxiliary inlets 13 for combustion air in FIG. 1 may terminate tangentially in the stack 3 and may be oriented in such a way that the air supplied thereby is given a spin having the same rotational direction as the spin of the combustion air supplied through the inlet 12. However, one, several or all of the auxiliary inlets 13 can be radially oriented.

The air nozzles 15 are also tangentially oriented in such a way that the air supplied by them has a spin, the rotational direction of which is the same as the rotational direction of the combustion air supplied through the inlets 12. Furthermore, the air nozzles 15 are inclined in the direction of the closure element 10 located at the end of the stack forming the lower end of the stack 3, i.e. in the direction of a step 18 in the stack wall 4.

Helically rising guide plates 17 are disposed inside the stack 3, between the air nozzles 15 and the auxiliary inlets 13 for combustion air. The spiral direction of the guide plates 17 has been selected in such a way that they impart a spin to the flue gases rising from the combustion chamber, which has the same rotational direction as the air supplied through the air nozzles 15. The guide plates 17 can also be made of finned pipes which are welded together.

The cross section of the stack widens between the air nozzles 15 and the guide plates 17, as seen in the direction of the flue gas flow towards the flue gas outlet connector 6 and forms the step 18 in the stack wall 4. Ash outlet openings 19 are formed in the step 18 disposed between the auxiliary inlet 13 for combustion air and the air nozzles 15. Ash can fall downwardly through the ash outlet openings 19 in the direction of the arrow 19*a* into a collecting chamber 80 and can be discharged to the outside through an ash conduit 81.

A cylindrical heating surface 20 of finned pipes welded together in an air-tight manner is also suspended from the support 9 inside the stack 3. The heating surface 20 is located between the auxiliary inlets 13 for combustion air and the convection heating surface 8 in the center of the stack 3, with which they are coaxial.

The space 7 between the stack wall 4 of the stack 3 and the inside of the hollow cylinder-like housing 2, the air nozzles 15, the inlet 12 for combustion air and the supply opening 11 for the fine grained coal are connected to a common air compressor 48 by means of connecting pipe lines, while the auxiliary inlets 13 for the combustion air communicate with the space 7. A coal supply conduit 23 terminates in a connecting pipe line 22 leading to the supply opening 11 for the fine grained coal, at a point outside the housing 2 located downstream of the location where the connecting pipe line 22 branches off from the other connecting pipe lines, as seen in the direction of the flow of air.

Figure 4:
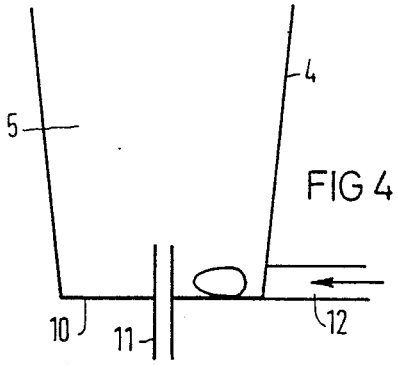
FIGS. 4 and 5 are respective fragmentary, longitudinal-sectional and top-plan views showing details of a device which is modified with respect to that of FIG. 1.
Figure 5:
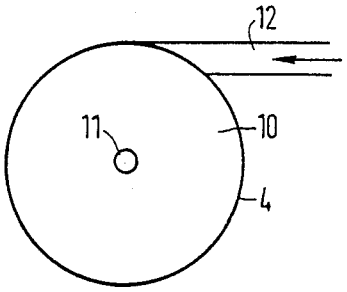

As shown in FIGS. 4 and 5, the inlet 12 for combustion air can also terminate tangentially in the combustion chamber 5. The tangential inlet 12 is oriented in such a way that the combustion air supplied by it has the same rotational direction as the combustion air supplied by the supply opening 12, which has the guide vanes 16 in accordance with FIGS. 2 and 3.

Figure 6:
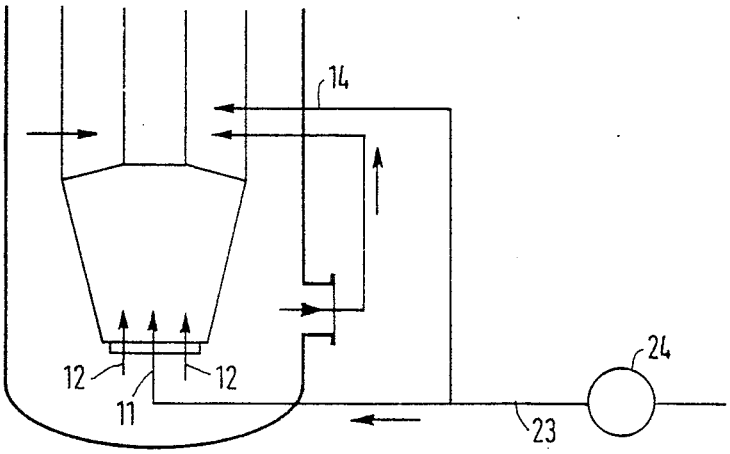
FIG. 6 is a fragmentary, largely diagrammatic, longitudinal-sectional view of a further modification of the device according to FIG. 1.

In accordance with FIG. 6 the supply opening 11 and the auxiliary inlets 14 for fine grained coal are connected to a pipe line 23 having a pump 24 for liquids, so as to supply a mixture of water and fine grained coal, which can be pumped. The inlet 12 for combustion air can be constructed according to either FIGS. 2 and 3 or FIGS. 4 and 5.

A mixture of water and fine grained coal can be supplied particularly easily to the combustion chamber 5 of the steam generator by means of the supply opening 11 and the auxiliary inlet 14. The combustion chamber 5 is subject to considerable overpressure on the side where flue gas is generated. Furthermore, the water evaporating in the combustion chamber 5 reduces and equalizes the combination temperature and thus adds to the reduction of nitrogen oxide generation.

The fact that the cross section of the combustion chamber 5 is in the form of a circle or a regular polygon aids in the formation of a spin of the combustion air in the combustion chamber 5 caused by the combustion air supplied through the inlet 12, and therefore it also aids in the ignition of the fine grained coal supplied through the supply opening 11. Blowing in a part of the total coal flow supplied to the combustion chamber 5 through the auxiliary inlet 14, located between the auxiliary inlet 13 for combustion air and the air nozzles 15, leads to a further reduction of the formation of nitrogen oxides.

The flue gas rising from the combustion chamber 5 inside the stack 3 is kept away from the inside of the stack wall 4 by the combustion air entering tangentially through the auxiliary inlet 13 as well as by the air supplied by the air nozzles 15. In this way, the stack wall is thus protected from corrosion by carbon monoxide contained in the flue gas.

The flue gas rising from the combustion chamber 5 is further deflected by the helically rising guide plates 17. Due to this movement and due to the air supplied through the air nozzles 15, the spin of the flue gas is increased, so that the ash carried along in the flue gas collects in the vicinity of the stack wall 4 and can be exhausted to a large degree through the outlet opening 19. The flue gas thus freed of dust to a large degree flows to the convection heating surfaces or plates 8 and is cooled there. Due to the small dust content of the flue gas, it not only causes little soiling of the convection heating surfaces 8, but a flue gas precipitator connected to the flue gas outlet connector 6 need only have a low degree of precipitation efficiency.

The movement in the direction of the ash outlet openings 19 of the ash carried along by the flue gas can be improved by a pulsing increase in the force of the air flow supplied through the air nozzles 15, while reducing the air flow supplied through the auxiliary inlets 13 according to the same pulse. Advantageously the sum of the two air flows remains approximately constant.

The heating surface 20 which is advantageously in the form of a cylinder is intended to lower the flue gas temperature in the combustion chamber 5 and, as a result of this, to also reduce the formation of nitrogen oxides. The finned pipes of the heating surface 20 are helically wound and are welded together in an air-tight manner. The heating surface 20 may be suspended from the supports 9 by outlets pipes 24'. The outlet pipes 24' can also serve as vertical support pipes for the convection heating surfaces 8 at the same time.

High flue gas pressure is intended to prevail in the stack 3, which decreases the reaction time between the fine grained coal and the combustion air. Thus the combustion area formed mainly of the combustion chamber 5 can have a comparatively small volume. In spite of this, the heating surface 20 can effect sufficient cooling of the flue gas rising from the combustion chamber 5 so that the ash carried along with the flue gas does not melt.

Since all of the air supplied to the steam generators according to FIGS. 1 to 6 originates in the same air compressor 48, the air pressure in the space 7 between the stack wall 4 and the inside of the hollow cylinder-like housing 2 is always greater than the pressure of the flue gas within the stack 3. For this reason flue gas cannot escape from the stack 3 into the space 7 through a leak in the stack wall 4.

The stack can also have the combustion chamber with the closure element, the supply opening for fine grained coal and the inlet for combustion air at the end of the stack which forms the upper end of the stack, and the stack can have the flue gas outlet connector at the other end of the stack forming the lower end of the stack, so that the flue gas flows from top to bottom in the stack.

Otherwise, such a steam generator can be constructed exactly as in FIGS. 1 to 6, with the exception that the air nozzles are inclined towards the lower end with the flue gas outlet connector and the step in the stack wall is constructed such that the outlet openings for ash provided therein move the ash to the end of the stack which forms the lower end thereof.

Figure 7:
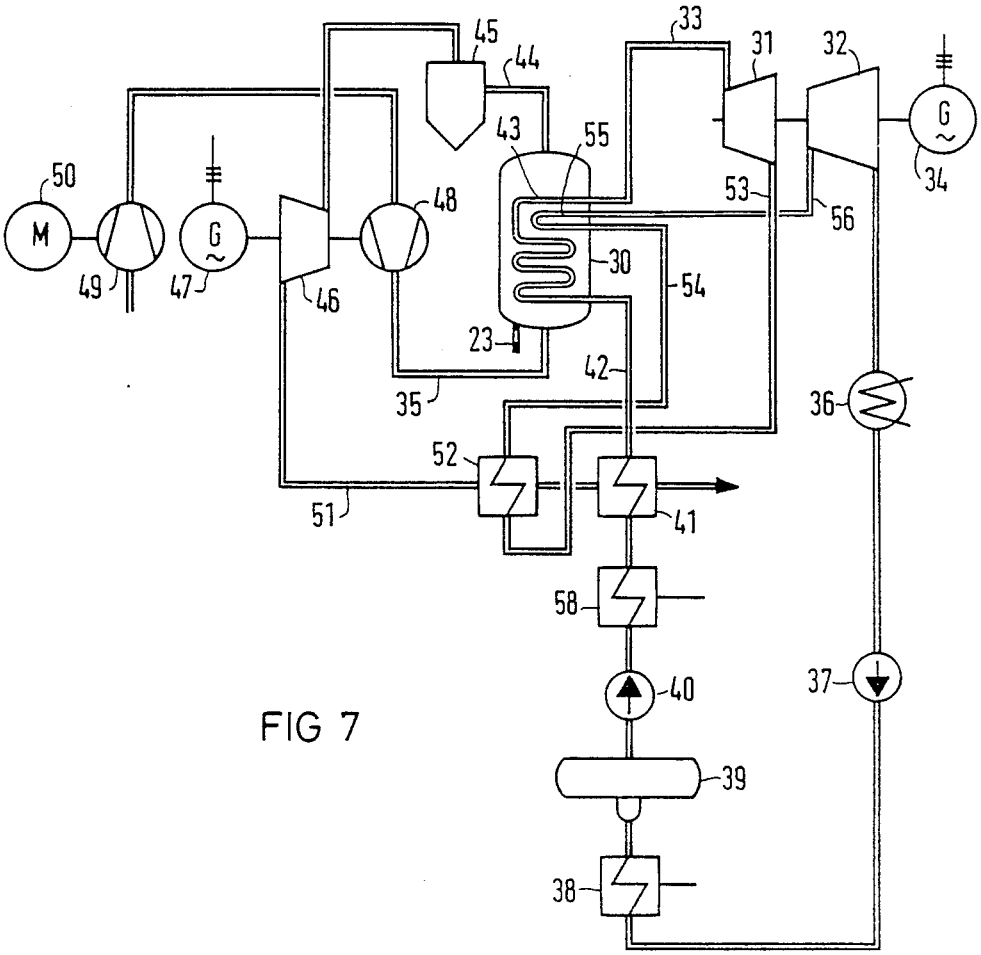
FIG. 7 is a schematic and largely simplified circuit diagram of a power plant with a device according to the invention in the form of a steam generator.

The combined gas/steam turbine power plant in accordance with FIG. 7 includes a steam generator 30 according to FIGS. 1 to 6, operated as a flow-through or continuous flow steam generator. A steam turbine having a high pressure part 31 and a medium and low pressure part 32 is connected to a live steam pipe 33 emanating from the steam generator 30 and is coupled with an electrical generator 34, which it drives. A supply line 23 for fine grained coal and a single connecting pipe 35 for air are indicated as being connected to the steam generator 30, in place of the connecting pipe lines emanating from the air compressor 48 shown in FIG. 1.

A condenser 36 is connected downstream of the medium and low pressure part 32 of the steam turbine and is followed by a condensate pump 37 which pumps condensate through a low pressure pre-heater 38 into a feed water container 39, which at the same time serves as a degasifyer. A feed water pump 40, with high pressure feed water pre-heaters 41 and 58 connected downstream thereof, is connected to the feed water container 39. The feed water container 39 is located in a feed water supply line 42 for high pressure heating surfaces 43 inside the steam generator 30. The high pressure heating surfaces 43 are formed by the finned pipes of the closure element 10, the stack wall 4 and the heating surface 20, as well as the guide plates 17 and two of the convection heating surfaces 8 of the steam generator according to FIGS. 1 to 6, which form economizer heating surfaces disposed in series relative to one another on the water supply side, evaporation heating surfaces and pre and end-superheater surfaces with live steam outlets leading to the live steam pipe 33.

A flue gas discharge line 44 containing a precipitator 45 is connected to the steam generator 30 or more specifically to the flue gas outlet connector 6 of the steam generator according to FIG. 1. A flue gas turbine 46, which is the drive unit for an electrical generator 47 as well as for the air compressor 48 in the air supply line 35 leading to the steam generator 30, is placed downstream of the precipitator 45. The walls of the precipitator 45 may be formed of finned pipes welded together in an air-tight manner for the transfer of flue gas heat to the water and steam circuit of the power plant. A further air compressor 49 is placed upstream of the air compressor 48 and has as a drive unit, such as an electric motor 50 with adjustable rpm. The two air compressors 48 and 49 form the air compressing device in accordance with FIG. 1.

A ribbed pipe heat exchanger 52 and the feed water high pressure pre-heater 41 are placed downstream of the flue gas turbine 46 and are disposed in series in a flue gas discharge line 51 leading away from the flue gas turbine 46. A steam line 53, which carries the intermediate steam of the high pressure part 31 of the steam turbine, is connected to the steam side of the ribbed pipe heat exchanger 52 which, in turn, is connected to a supply line 54 of an intermediate superheater heating surface 55 in the steam generator. The intermediate superheater heating surface 55 is one of the convection heating surfaces 8 of the steam generator in accordance with FIGS. 1 to 6. A steam discharge line 56 of the intermediate superheater heating surface 55 leads to the medium and low pressure part 32 of the steam turbine.

The steam flowing from the high pressure part 31 to the medium and low pressure part 32 of the steam turbine is heated in the ribbed pipe heat exchanger 52 before reaching the intermediate superheater heating surface 55 in the steam generator 30 and then the medium and low pressure part 32 of the steam turbine. This also increases the efficiency of the power plant shown in FIG. 7.

While the flue gas turbine 46 driving the air compressor 48 is driven at constant rpm, the rpm of the electric motor 50 driving the air compressor 49 is reduced when the power plant is under partial load. In this way, the air mass flow conveyed by the compressor 49 is reduced and the air pressure upstream of the air compressor 48 is also reduced. This means that the gas pressure in the steam generator 30 or in the stack 3 of the steam generator according to FIGS. 1 to 6 also falls, so that the effective air and flue gas speeds in the stack 3, which are important for the transport of dust, the course of combustion and the discharge of ash through the outlet opening 19, do not increase in proportion to the load.

Figure 8:
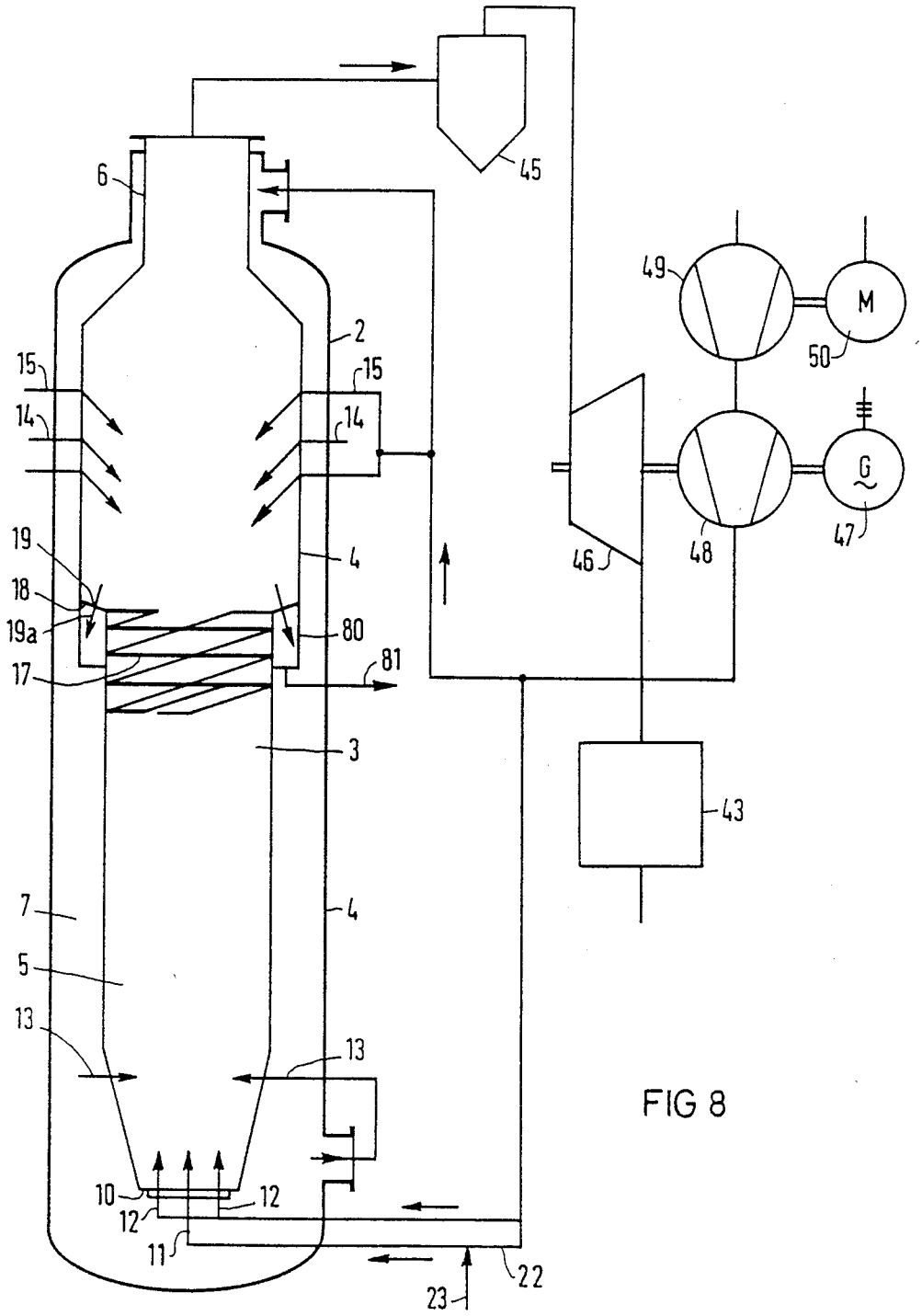
FIG. 8 is a view similar to FIG. 1 of another embodiment of a device according to the invention.

FIG. 8, in which parts like those in FIGS. 1 to 6 have the same reference numerals, shows a device for the production of flue gas which differs from the device of FIG. 1 in the form of a steam generator, by not having convection heating surfaces inside the stack 3 upstream of the flue gas outlet connector 6, nor a heating surface hanging in the center of and coaxial to the stack 3. Furthermore, the auxiliary inlet 14 for fine grained coal is not placed between the guide plate 17 and the combustion chamber 5, but rather between the guide plate 17, which is made of steel or ceramic material, and the flue gas outlet connector 6, at approximately the same location as the air nozzles 15. The stack wall 4 is made of sheet steel.

The flue gas turbine 46, driving the first air compressor 48 and the electric generator 47, is connected to the flue gas outlet connector 6, with the precipitator 45 connected therebetween. The second air compressor 49, having the electric motor 59 with adjustable rpm as drive unit, is placed upstream of the first air compressor 48. The air compressors 48 and 49 of FIG. 8 are operated in the same way as the corresponding air compressors 48 and 49 of FIG. 7. A steam generator 43 which feeds steam that may flow to a non-illustrated steam turbine, is disposed downstream, on the gas discharge side of the flue gas turbine 46.

The guide plate 17 of FIG. 8 can also be formed by pipes which are welded together and can be a convection heating surface, so that the steam generated in the steam generator 43 can be fed through the pipes of the guide plate 17 and can be superheated on its way to the non-illustrated steam turbine.

The foregoing is a description corresponding in substance to German Application P 37 03 945.8, dated Feb. 9, 1987 and P 37 41 196.9, dated Dec. 4, 1987, the International priority of which is being claimed for the instant application, and which is hereby made part of this application. Any material discrepancies between the foregoing specification and the aforementioned corresponding German application are to be resolved in favor of the latter.

We claim:

1. Device for generating flue gas for driving a gas turbine, comprising a closed hollow cylindrical housing having an air inlet connector, a stack longitudinally extended in said housing, said stack having upper and lower ends and having a stack wall spaced from said housing defining an intermediate space therebetween, a combustion chamber disposed at one of said ends of said stack, a closure element disposed at said one end of said stack, inlet opening means for combustion air being disposed at said one end of said stack and discharging into said combustion chamber, supply opening means for fine grained coal disposed at said one end of said stack and forming a pulverized coal burner along with said inlet opening means, first auxiliary inlet means for combustion air discharging in said combustion chamber, second auxiliary inlet means for fine grained coal disposed in said stack wall and discharging into said combustion chamber a distance from said closure element, a flue gas outlet connector disposed in and spaced from said air inlet connector of said housing at said other end of said stack, an air nozzle disposed in said stack wall a distance from said first auxiliary inlet means as seen in flue gas flow direction, said air nozzle discharging tangentially into said stack providing means for creating a spin in supplied air having a given rotational direction and ending in said stack in a direction toward said lower end of said stack, a helically shaped guide plate for flue gas disposed on said stack wall inside said stack between said first auxiliary inlet means and said air nozzle, said guide plate being wound in a direction providing means for importing a spin to the flue gas having said given rotational direction, said stack wall having a step formed therein defining a change in cross section of said stack, and said step having an outlet opening for ash disposed therein.

2. Device according to claim 1, wherein said means for generating a spin of the combustion air are in the from of a tangential inlet leading into said combustion chamber.

3. Device according to claim 2, wherein said means for generating a spin of the combustion air are in the from of guide vanes.

4. Device according to claim 1, wherein said step is disposed between said guide plate and said air nozzle.

5. Device according to claim 1, wherein said step is disposed between said air nozzle and said flue gas outlet connector.

6. Device according to claim 1, wherein said stack wall is formed of pipes air-tightly welded together.

7. Device according to claim 1, wherein said closure element is formed of pipes air-tightly welded together.

8. Device according to claim 1, wherein said first auxiliary inlet means are disposed at a distance from said closure element.

9. Device according to claim 1, wherein said stack has a convection heating surface at said other end thereof containing said flue gas outlet connector, and said supply opening means and said inlet opening means of said pulverized coal burner are disposed upstream of said convection heating surface as seen in said flue gas flow direction.

10. Device according to claim 9, wherein said step is disposed between said air nozzle and said convection heating surface.

11. Device according to claim 1, including a pump supplying a pumpable mixture of water and fine grained coal to said pulverized coal burner.

12. Device according to claim 1, wherein said combustion chamber has a cross section in the form of a circle.

13. Device according to claim 1, wherein said combustion chamber has a cross section in the form of a regular polygon.

14. Device according to claim 8, wherein said first auxiliary inlet means discharge tangentially into said combustion chamber providing means for creating a spin in supplied combustion air in said given rotational direction.

15. Device according to claim 8, wherein said first auxiliary inlet means discharge radially into said combustion chamber.

16. Device according to claim 8, wherein said combustion chamber has a cross section increasing upstream of said first auxiliary inlet means as seen in said flue gas flow direction, starting at said one end of said stack containing said closure element.

17. Device according to claim 1, wherein said guide plate is formed of pipes welded air-tightly together forming a convection heating surface.

18. Device according to claim 1, including an air compressor communicating with said intermediate space, with said air nozzle and with said inlet opening means, and said first auxiliary inlet means communicate with said intermediate space.

19. Device according to claim 9, including a heating surface formed of air-tightly welded together pipes disposed in the center of said stack between said first auxiliary inlet means and said convection heating surface.

20. Device according to claim 18, including a further air compressor upstream of said first-mentioned air compressor, and a drive unit with adjustable rpm being connected to said further air compressor.

21. Device according to claim 1, wherein said inlet opening means include means for generating a spin of the combustion air in said given rotational direction.

22. Device according to claim 1, wherein said inlet opening means direct the combustion air in an axial direction.

* * * * *

UNITED STATES PATENT AND TRADEMARK OFFICE

CERTIFICATE OF CORRECTION

PATENT NO. : 4,841,727

DATED : June 27, 1989

INVENTOR(S) : Wittchow, et al

It is certified that error appears in the above-identified patent and that said Letters Patent is hereby corrected as shown below:

Column 2, Line 22, "are in the from of a tangential"
should read:
- - are in the form of a tangential - - .

In the Claims:

Claim 2, Line 1, "Device according to claim 1"
should read:
- - Device according to claim 21 - - ;

Line 3, "from of a tangential"
should read:
- - form of a tangential - - .

UNITED STATES PATENT AND TRADEMARK OFFICE
CERTIFICATE OF CORRECTION

PATENT NO. : 4,841,727

DATED : June 27, 1989

INVENTOR(S) : Wittchow, et al

It is certified that error appears in the above-identified patent and that said Letters Patent is hereby corrected as shown below:

Claim 3, Line 1, "Device according to claim 2"
should read:
- - Device according to claim 21 - - ;
Line 3 "from of guide vanes"
should read:
- - form of guide vanes - - .

Signed and Sealed this

Twenty-fourth Day of September, 1991

*Attest:*

HARRY F. MANBECK, JR.

*Attesting Officer*

*Commissioner of Patents and Trademarks*